United States Patent [19]

Hoshi

[11] 4,368,879

[45] Jan. 18, 1983

[54] CUTTING AND FOLDING APPARATUS IN ROTARY PRESS

[75] Inventor: Toshio Hoshi, Toride, Japan

[73] Assignee: Komori Printing Machinery Company, Ltd., Tokyo, Japan

[21] Appl. No.: 161,782

[22] Filed: Jun. 23, 1980

[51] Int. Cl.[3] ..... B41F 13/58

[52] U.S. Cl. ..... 270/6; 270/42; 493/432

[58] Field of Search ..... 270/5-7, 270/10, 13-15, 19, 38, 42, 43, 44, 47-50, 60; 493/424-429, 431-432

[56] References Cited

U.S. PATENT DOCUMENTS

| | | | |
|---|---|---|---|
| 2,335,431 | 11/1943 | Meyer | 493/429 |
| 2,991,995 | 7/1961 | Zuckerman | 270/6 |
| 3,521,512 | 7/1970 | Woessner | 270/60 |
| 3,762,697 | 10/1973 | Bolza-Schunemann | 270/6 |
| 3,784,187 | 1/1974 | Takayanagi | 270/6 |

*Primary Examiner*—Edgar S. Burr
*Assistant Examiner*—A. Heinz
*Attorney, Agent, or Firm*—Charles E. Pfund

[57] ABSTRACT

A cutting and folding apparatus receives a printed web from a printing section including a plate cylinder and produces a variety of signatures. The apparatus includes a folding cylinder having a diameter two or more times as large as that of the plate cylinder, a collecting cylinder adjacent the folding cylinder and having a diameter 1.5 times as large as that of the plate cylinder, a pin cylinder adjacent the collecting cylinder and having the same diameter as the plate cylinder, and a gripping cylinder adjacent the folding cylinder and having the same diameter as the folding cylinder. To obtain superimposed signatures, cutting knives circumferentially provided on the folding cylinder transversely sever, in cooperation with holding members on the collecting cylinder, the running web supplied therebetween. The severed sheets are held by the holding members and superimposed one over the other, two superimposed sheets being successively transferred to the pin cylinder for delivery. For producing transversely folded signatures, cutting and holding members are provided on the folding cylinder and transversely sever the running web and holding the severed webs. Jaws on the gripping cylinder can cooperate with tucker blades for folding the severed webs carried by the folding cylinder.

12 Claims, 21 Drawing Figures

FIG.18
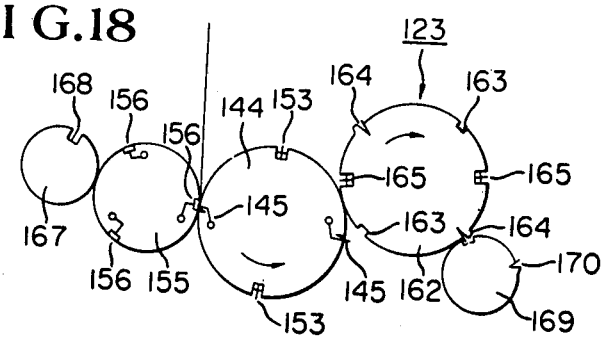
FIG.19(a)
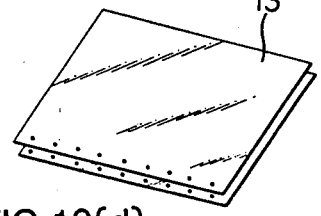
FIG.19(b)
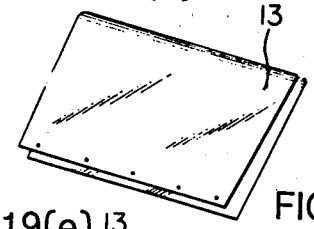
FIG.19(c)
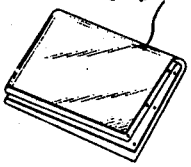
FIG.19(d)
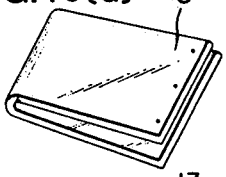
FIG.19(e)
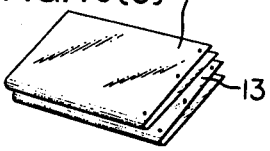
FIG.19(f)
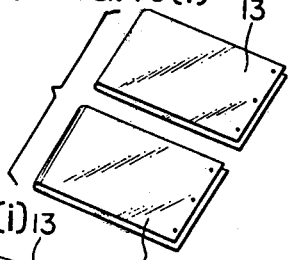
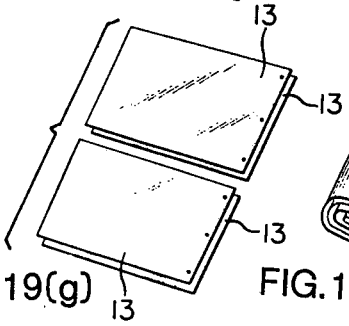
FIG.19(g)
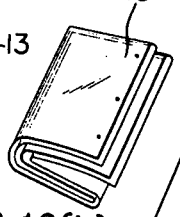
FIG.19(h)
FIG.19(i)
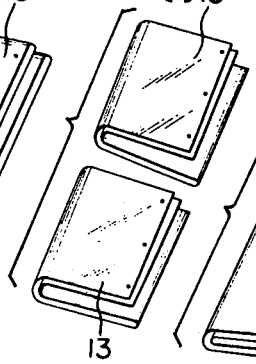
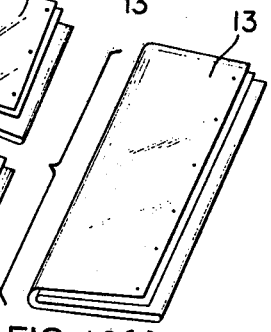
FIG.19(j)

CUTTING AND FOLDING APPARATUS IN ROTARY PRESS

BACKGROUND OF THE INVENTION

This invention relates generally to rotary press, and more particularly to a cutting and folding apparatus for rotary press, which is capable of producing various signatures by simple switching operations.

In the printing operation by a rotary press, a wide paper web is fed to a printing unit by a web feeder to undergo printing and, after drying, the printed web is fed to a folding machine to be formed into folded signatures. FIG. 1 shows by way of example a conventional folding machine for rotary press, wherein a paper web 1, which has been printed through the printing unit, is fed to a folding cylinder 5 through a drag roller 2, lead rollers 3, and nipping rollers 4. The web 1 is severed into a predetermined size between the folding cylinder 5 and a cutting cylinder 6 which is opposingly revolving thereagainst, and then folded into a ½ size between the folding cylinder 5 and a similarly opposingly revolving gripping cylinder 7, centrally along a line transverse to the direction of travel of the web 1, the folded paper being transferred by a delivery belt 8 to an impeller wheel 9 and discharged out of the apparatus by a conveyor 10. Where ½ of this size is desired, the folded signature is folded again centrally along a line parallel to the direction of travel by a chopper folder 11 which is provided at a position halfway of the length of the delivery belt 8, and discharged onto a fixed type conveyer 12 by an impeller wheel which is not shown. In this instance, the conveyor 10 is lowered to the position shown in phantom for connection to the paper discharging conveyer 12. The signature 13 discharged in this manner contains A3×4 pages as shown at (*a*) of FIG. 2 when the chopper 11 is not employed and A4×8 pages as shown at (*b*) when the signature is double-folded by the use of the chopper 11. Recently, there are considerable increases in the number of printed matter of small pagination such as A3×2 pages or A4×4 pages. In order to obtain such prints, for instance, two copies of A3×2 pages as shown at (*c*) of FIG. 2 with the above-mentioned folding apparatus, it becomes necessary to sever the fold 13*a* of the signature of A3×4 pages shown at (*a*). On the other hand, in order to obtain two signatures of A4×4 pages shown at FIG. 2 (*d*), it is necessary to sever the fold 13*b* of the signature of A4×8 shown at FIG. 2(*d*) and then to extract each signature one after another. This makes the operation complicated and inefficient and increases the cost of equipment due to the necessity for the provision of an additional cutting device. There has been developed a folding apparatus which is specifically designed to make signatures of A3×2 pages and A4×4 pages but it is unable to make other signatures, requiring installation of other folding and cutting apparatus in order to make different kinds of signatures.

SUMMARY OF THE INVENTION

The present invention provides a rotary press including a plate cylinder for printing a web travelling at a predetermined linear speed, and a web feed section for receiving the printed web from the plate cylinder and feeding the web to a cutting and folding section at the predetermined linear speed. The cutting and folding section includes: a folding cylinder having a diameter n-times as large as the diameter of the plate cylinder (n herein and hereinafter is an integer of 2 or more) and rotatable at a circumferential speed same as the linear speed of the travelling web; a collecting cylinder disposed adjacent the folding cylinder and having a diameter 1.5 times as large as the diameter of the plate cylinder, the collecting cylinder being rotatable at the same circumferential speed as and in a direction inverse of the folding cylinder; a gripping cylinder disposed adjacent the folding cylinder and having a diameter same as the folding cylinder, the gripping cylinder being rotatable at the same circumferential speed as and in a direction inverse of the folding cylinder; a pin cylinder disposed adjacent the collecting cylinder and having the same diameter as the plate cylinder, the pin cylinder being rotatable at the same circumferential speed as and in a direction inverse of the collecting cylinder; n-number of cutting and holding means and n-number of first tucker blades alternately and equidistantly mounted on the circumference of the folding cylinder, each one of the cutting and holding means being adapted to release its hold at a predetermined position; 2n of first cutting knives mounted on the folding cylinder in the positions intermediate between adjacent cutting and holding means and first tucker blade; three first holding members circumferentially equally spaced on the collecting cylinder, each first holding member being cooperative with either one of the cutting and holding means or one of the first cutting knives and adapted to release its hold at each two revolutions of the collecting cylinder, so that the web fed between the folding and collecting cylinders from the web feed section (a) is transversely severed successively at each revolution of the collecting cylinder into n-number of first severed sheets each having a length same as the circumferential length of the plate cylinder when the first holding members on the collecting cylinder are in cooperation with the cutting and holding means on the folding cylinder, the first severed sheets being held on the cutting and holding means to be carried by the folding cylinder, or (b) is transversely severed successively at each revolution of the folding cylinder into 2n-number of second severed sheets each having a length half the circumferential length of the plate cylinder when the first holding members on the collecting cylinder are in cooperation with the first cutting knives on the folding cylinder, the second severed sheets being successively held by the first holding members and carried by the collecting cylinder such that every third one of the second severed sheets is superimposed on the first one; a second holding member provided on the pin cylinder to receive the two superimposed second sheets carried by the collecting cylinder and to deliver the superimposed sheets to a first delivery location; and n-number of first jaws circumferentially equally spaced on the gripping cylinder and each being cooperative with one of the first tucker blades of the folding cylinder for transversely folding the first severed sheets to form folded signatures, holding the folded signatures and delivering same to a second delivery location.

It is, therefore, an object of the present invention to provide a cutting and folding apparatus capable of producing variety of signatures from printed webs.

Another object of the invention is to provide a cutting and folding apparatus applicable to high speed printing.

BRIEF DESCRIPTION OF THE DRAWINGS

Other objects, features and advantages of this invention will become more apparent from the detailed description of the preferred embodiments which follow, when considered in light of the accompanying drawings, in which:

FIG. 6(*b*) is a plan view schematically showing an adjusting member for adjusting relative arrangement of a collecting cylinder to a folding cylinder of the cutting and folding section of FIG. 6(*a*);

FIG. 18 shows diagrammatically the organization of a further cutting and folding section of the invention; and FIGS. 19(*a*) through (*j*) are perspective illustration of signatures obtained with the use of the cutting and folding apparatus of the present invention.

DETAILED DESCRIPTION OF PREFERRED EMBODIMENTS OF THE INVENTION

Figure 1:
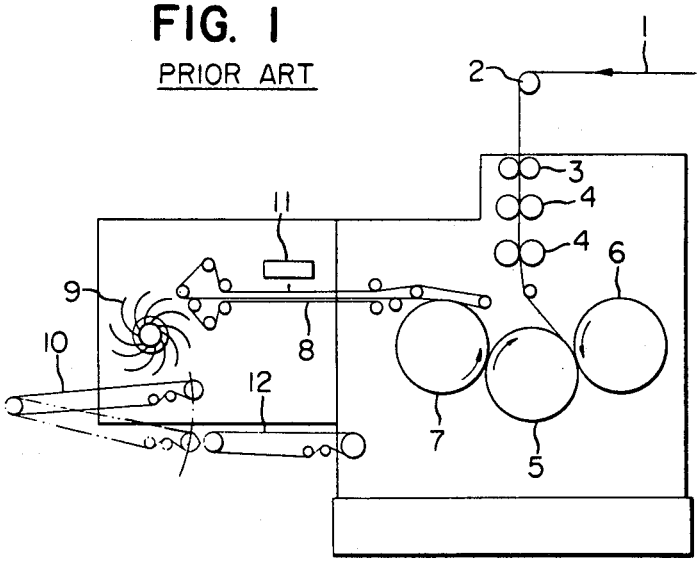
FIG. 1 PRIOR ART
FIG. 1 is a diagrammatic side elevation of a conventional folding machine.
Figure 2A:
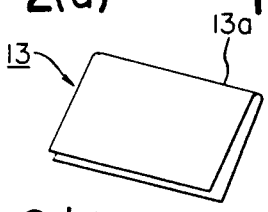
PRIOR ART FIG. 2(a)
FIG. 2 is a perspective view illustrating folded signatures produced by using the conventional folding machine.
Figure 2C:
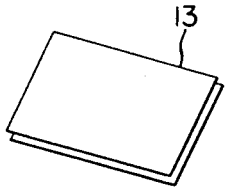
Figure 2B:
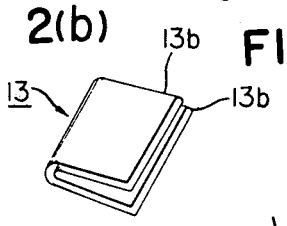
Figure 2D:
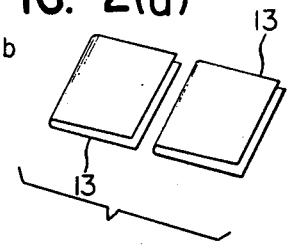
Figure 3:
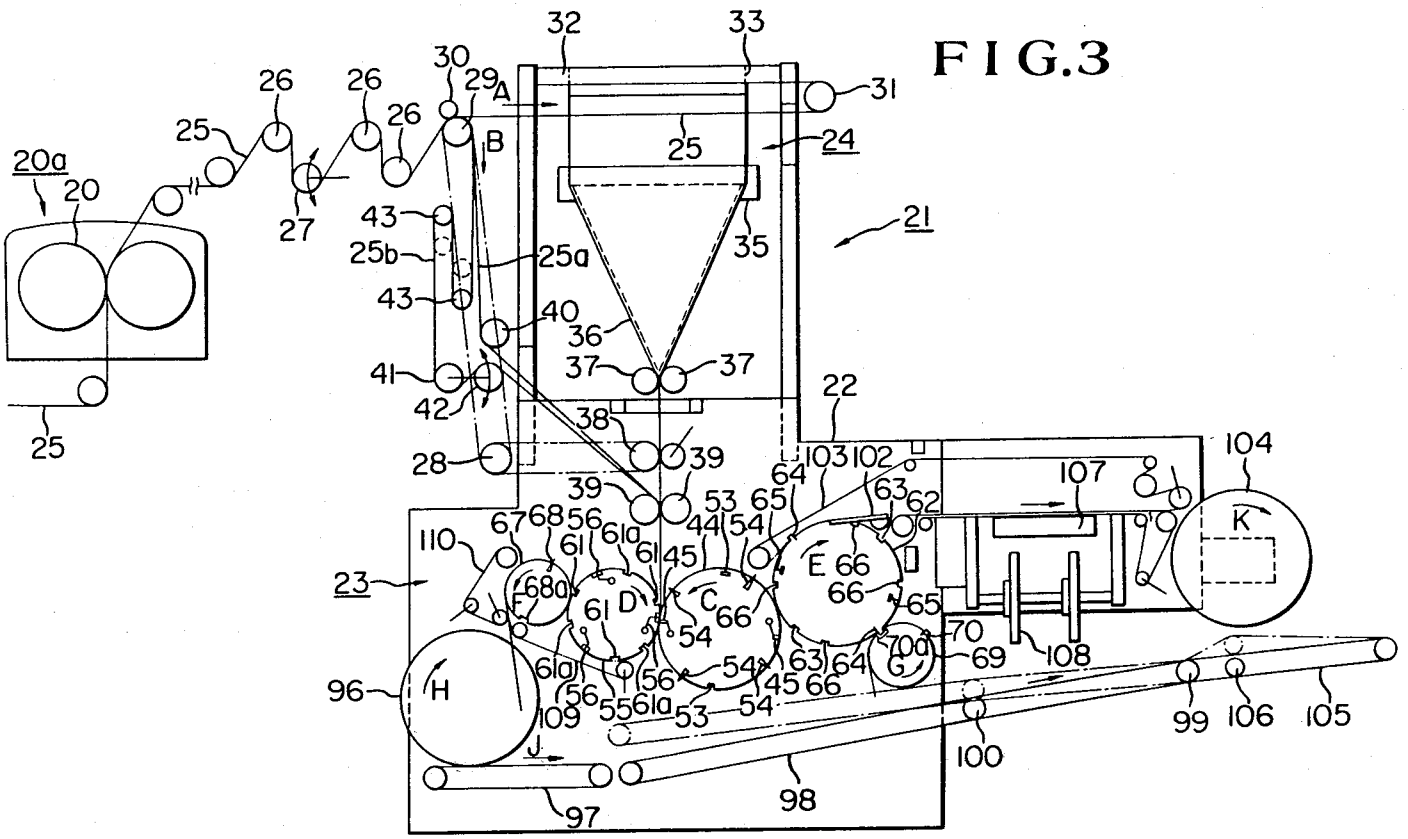
FIG. 3 is a diagrammatic side elevation of a rotary press having a cutting and folding apparatus of the present invention.

Referring to FIG. 3, designated generally as 21 is cutting and folding apparatus having a cutting and folding section 23 including a group of cylinders which will be described hereinlater, and a web feed section 24 which is formed in the upper portion of a frame 22. A running web 25 is printed on one or both sides thereof in a printing section 20*a* with a plate cylinder 20 and is then led to the web feed section 24. Journalled at the entrance of the web feed section 24 are three guide rollers 26, a compensator roller 27 which is movable up and down through rocking arms, and a drive roller 29 which is located downstream of the guide rollers 26 and rotatingly driven by a drive pulley 28 through a belt. Above the center portion of the drive roller 29, a slitter 30 in the form of a thin-walled disc is supported on rocking arms for movement toward and away from the drive roller 29. Upon lowering, the slitter 30 engages an annular groove on the drive roller 29 to sever the web 25 at the midpoint and along a line parallel with the direction of the movement of the web. This slitter 30 is selectively used according to the kind of the signature to be produced and fixed in a lifted position when not used.

Figure 4:
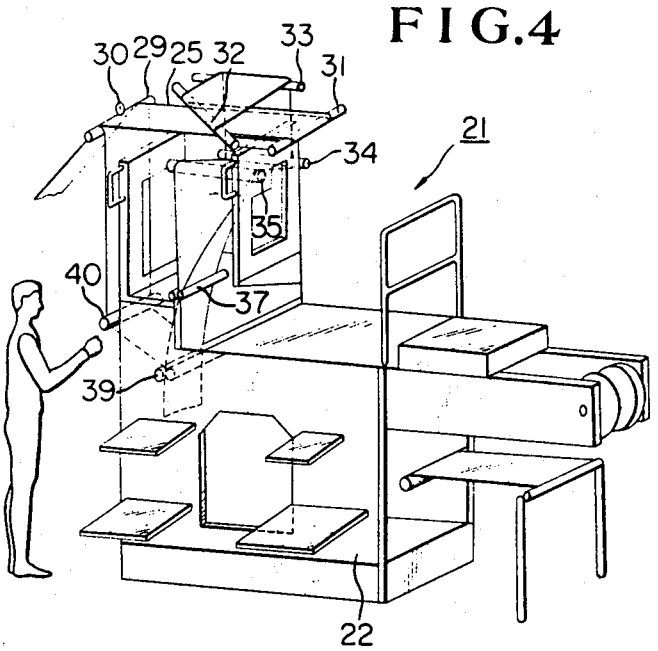
FIG. 4 is a perspective illustration of the cutting and folding apparatus employed in the press of FIG. 3.
Figure 5A:
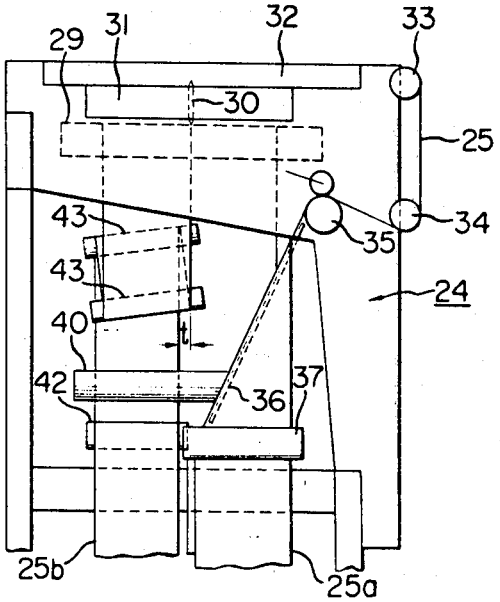
FIG. 5(*a*) is a fragmentary side elevation diagrammatically showing a web feed section of the cutting and folding apparatus of FIG. 4 and FIG. 5(*b*) is a fragmentary plan view of the web feed section of the cutting and folding apparatus.
Figure 5B:
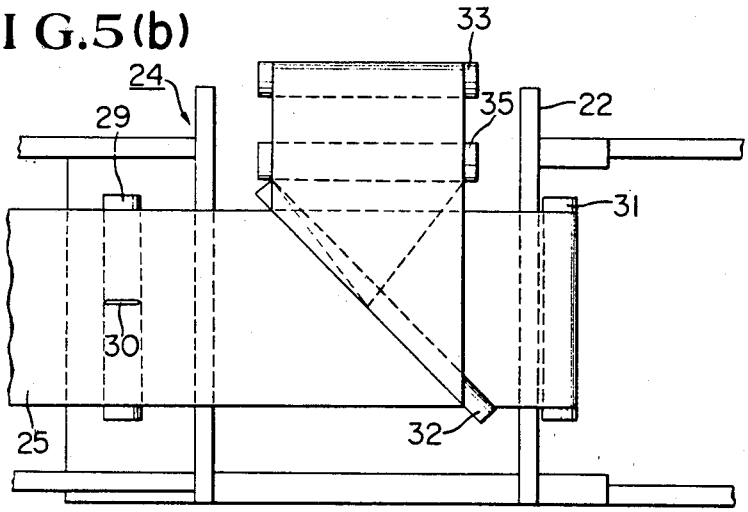

The web 25 which comes out of the drive roller 29 can take either one of the paths of travel indicated by arrows A and B and threaded into one of these paths according to the kind of signature to be formed. More particularly, the path A has a guide roller 31 which is journalled parallel with the drive roller 29 on opposite side of the frame 22 to turn the web 25 into the opposite direction. As shown in FIGS. 4 and 5*b*, a turn bar 32 is provided between the drive roller 29 and the guide roller 31 at an angle of 45° relative to the machine frame to turn at right angles the web 25 which has been reversed by the guide roller 31, the turn bar 32 having its lower end disposed at the same level with the upper end of the guide roller 31. A pair of upper and lower guide rollers 33 and 34 are journalled on the side end portions of the web feed frame 22 in an orientation perpendicular to the drive roller 29. The upper end of the guide roller 33 is in level with the upper end of the turn bar 32 and a drive roller 35 is journalled in a position adjacent to and parallel with the lower guide roller 35. The drive roller 35 is operatively connected to the drive roller 29, for instance, through a belt and a bevel gear box which are not shown. Provided beneath the drive roller 35 is a former 36 in the form of a triangular plate which folds the web 25 in half in the direction of its travel. A pair of lead rollers 37 are journalled at the lower end of the former 36. Further journalled beneath the lead rollers 37 is nipping rollers 38 which are driven from the pulley 28. A pair of nipping rollers 39 are journalled beneath the rollers 38. In this path A, the web 25 is folded in half by the former 36 and led to the nipping rollers 39.

The path B has two routes depending upon whether or not the slitter 30 is used. When the slitter 30 is in the upper retreated position and disengaged from the web 25 on the drive roller 29, the web 25 is led to the nipping rollers 39 through the drive roller 29 and guide roller 40. On the other hand, when the slitter 30 is in the service position and in engagement with the drive roller 29, the web on the drive roller 29 is slitted into two strips by the slitter 30, the two strips being led to the afore-mentioned nipping rollers 39 through two separate routes. As seen in FIGS. 3 and 5*a*, one strip 25*a* of the slitted web is led to the nipping rollers 39 through a guide roller 40 which is provided beneath the drive roller 29. The other strip 25*b* is led to the nipping rollers 39 via a pair of a guide roller 41 and a guide roller 42 which are provided beneath the guide roller 40. Provided between the drive roller 29 and the guide roller 41 are a pair of turn bars 43 the positions of which are vertically adjustable, the turn bars 43 being held in parallel tilted positions to shift the strip 25*b* widthwise so that it will be spaced from the other strip 25*a* by a predetermined distance when it reaches the nipping rollers 39, as indicated by reference character t in FIG. 5*a*.

The folding and cutting section 23 is provided beneath the feeding section 24 of the above-described construction to receive therefrom the web and to perform severing, folding and superimposing operations for obtaining desired signatures. The section 23 includes a folding cylinder 44, a collecting cylinder 55, a pin cylinder 67 and a gripping cylinder 62 which are all journalled on the frame 22.

Figure 6B:
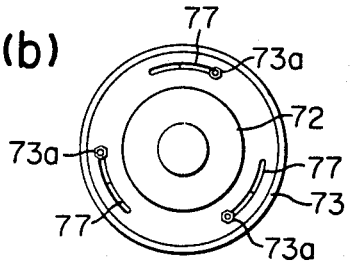
FIG. 6(*a*) is a developed plan view, partially in cross section, diagrammatically showing an arrangement of a cutting and folding section of the apparatus of FIG. 4.
Figure 6A:
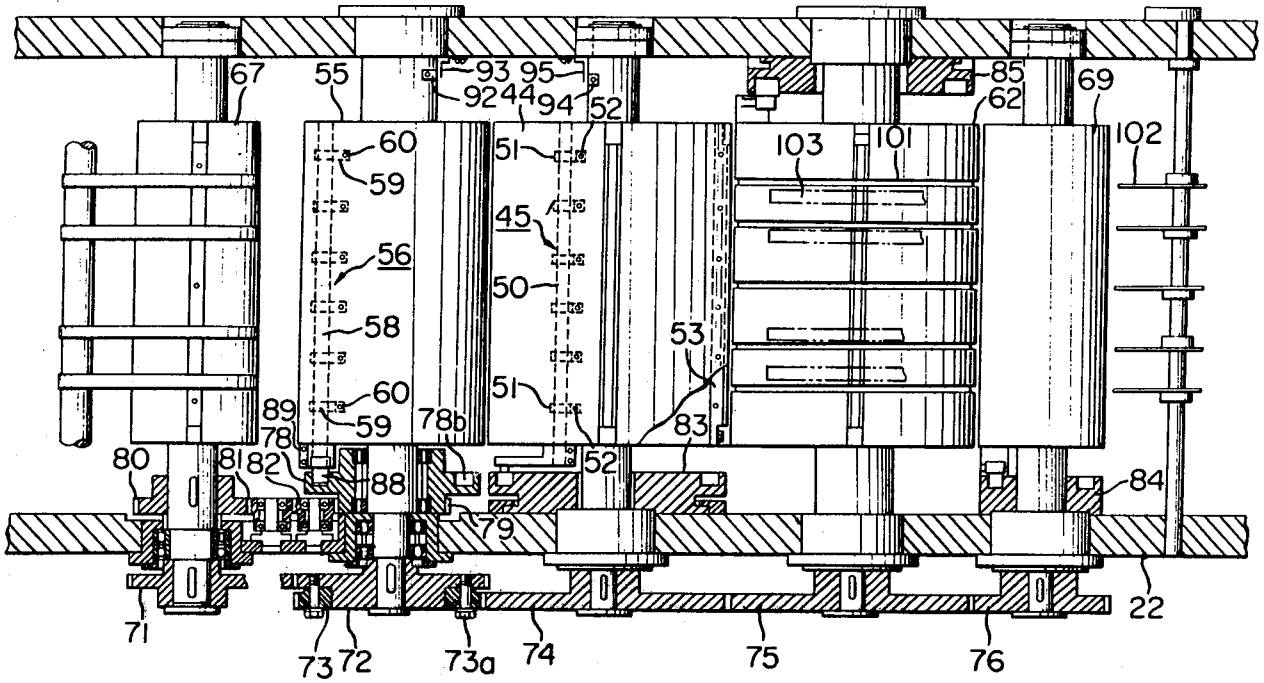
Figure 10:
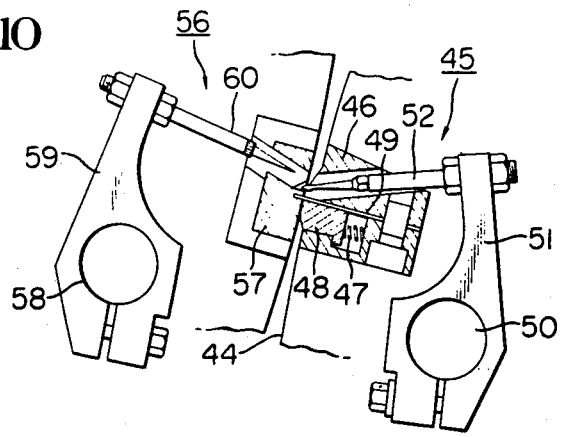
FIG. 10 is an enlarged fragmentary side view, partially in cross section, showing cut and holding means in association with a holding member.

Referring again to FIG. 3, the folding cylinder 44 has an effective diameter or circumferential length n times (in this illustrated case two times) greater than that of the plate cylinder 20 of the printing unit 20*a* and rotates at a circumferential speed same as the travelling speed of the web 25. The folding cylinder 44 has n-number of (in this illustrated case two) cutting and folding means 45 which are circumferentially equally spaced with each other and each of which is received in respective one of axial grooves on the circumference of the folding cylinder 44. As shown particularly in an enlarged cutaway view of FIG. 10, each cutting and folding means 45 includes a pressing plate 48 which is mounted on a support member 46 which is in turn supported within the axial groove along the whole length and parallel with the axis of the folding cylinder, the pressing plate 48 being biased radially outward by a coil spring 47. Interposed between the pressing plate 48 and the support member 46 is a second cutting knife such as a serrated knife 49 which extends along the whole length of the cylinder in parallel relation with the axis thereof. A number of levers 51 are mounted side-by-side on a lever shaft 50 which is mounted within the axial groove parallel with the support member 46 and which is rotated by a cam as will be described hereinlater to project and retract pins 52 at the fore ends of the respective levers 51 through a perforation in the support member 46. The pins 52 are provided in a several number in the axial direction of the cylinder (FIG. 6).

Referring again to FIG. 3, the folding cylinder 44 is further provided on its circumference with n-number of (in this illustrated case two) elongated axial grooves in the middle of adjacent cutting and holding means 45, the elongated groove each receiving therein a first tucker blade 53 which extends along the whole length of the folding cylinder 44 at a level flush with or slightly retracted from the circumferential surface of the cylinder. If desired, the first tucker knife 53 may be projected cut of the circumferential surface of the cylinder. In such a case, however, it is necessary to retract the tucker blades 53 into the cylinder at a position whenever it meets and comes into contact with the collecting cylinder 55. The mechanism for retracting the tucker blades 53 at a predetermined position is well known in the art.

In each position shifted by an angle $\alpha$ downstream from the positions of the tucker blades 53 and the cutting and holding means 45, a first cutting knife such as a serrated knife 54 is provided. Each knife 54 is received in an axial groove and extends along the whole length of the cylinder. The angle $\alpha$ is greater than 0° and smaller than 180°/n (in this illustrated case 90°, preferably 30°).

Journalled in association with the folding cylinder 44 thus constructed in a collecting cylinder 55 which has an effective diameter 1.5 times greater than that of the plate cylinder or equivalent to 3/2n (in this illustrated case, $\frac{3}{4}$) of the effective diameter of the folding cylinder 44, the collecting cylinder 55 rotating in the opposite direction and at the same circumferential speed relative to the folding cylinder 44. The collecting cylinder 55 is provided with three first cutting and holding members 56 equally spaced around its circumference. As shown particularly in the enlarged cutaway view of FIG. 10 and perspective view of FIG. 11, the first cutting and holding members 56 are each composed of a block 57 of a resilient material such as rubber which is mounted in an axial groove along the entire length of the cylinder 55, and a number of pins 60 threaded on levers 59 which are mounted side-by-side on a lever shaft 58 which is in turn rotatably mounted within the axial groove parallel with the axis of the cylinder. These pins 60 are adapted to be projected or retracted through apertures in the block 57 out of or into the circumferential surface of the cylinder by rotating the lever shaft 58 through a cam mechanism which will be described hereinlater. The knives 49 and 54 of the folding cylinder 44 fit into and cooperate with the blocks 57 to transversely sever the web supplied therebetween.

Referring again to FIG. 3, the collecting cylinder 55 is provided with elongated grooves 61 and 61*a* extending axially along the whole length of the cylinder in positions shifted respectively $\frac{2}{3}n\cdot\alpha°$ (in this illustrated case $4/3\cdot\alpha°$) backward and forward from the cutting and holding means 56 as seen in the direction of rotation of the collecting cylinder 55. In other words, the elongated axial groove 61*a* is provided on the circumference of the collecting cylinder 55 in a position which meets the cutting and holding means 45 of the folding cylinder 44 when the two cylinders are rotated in the respective positions confronting the serrated knife 54 of the collecting cylinder 55 and the cutting and holding member 45 of the folding cylinder 44 with each other. While, the elongated axial grooves 61 are provided on the circumference of the collecting cylinder 55 in a position which meets a serrated knife 54 on the folding cylinder 44 when the serrated knives 49 of the folding cylinder 44 and the resilient blocks on the collecting cylinder 55 are confronted with each other.

Thus, in the illustrated case, i.e. in case n is 2, if the two cylinders are rotated from an initial set position in which one holding member 56 of the collecting cylinder 55 is in abutting engagement with one cutting and holding means 45 of the folding cylinder 44, the serrated knife 54 of the folding cylinder is confronted with the groove 61 of the collecting cylinder when the folding and collecting cylinders are rotated through $\alpha°$ and $4/3\cdot\alpha°$, respectively. When the folding cylinder turns further through $90°-\alpha°$, that is to say, a quarter turn from the initial set position, the collecting cylinder makes a $\frac{1}{3}$ turn from the initial position, as a result bringing the tucker blade 53 of the folding cylinder into confrontation with the holding member 56 of the collecting cylinder. If the folding cylinder turns further through $\alpha°$ from this point, the serrated knife 54 of the folding cylinder comes into confrontation with the groove 61 of the collecting cylinder. At the time when the folding cylinder makes a half turn from the initial position, the collecting cylinder takes $\frac{2}{3}$ turn to confront the cutting and holding means 45 of the folding cylinder into with the holding member 56 of the collecting cylinder.

Under these circumstances, if the web 25 is fed between the folding cylinder 44 and the collecting cylinder 55 at a speed same as the circumferential speed of the two cylinders, the cutting means 45 and the holding member 56 meet twice during one revolution of the folding cylinder to sever the web two times, impaling and holding on the pins 52 the severed webs which have a length corresponding to half the circumferential length of the folding cylinder or equivalent to the circumferential length of the plate cylinder.

If the folding cylinder is advanced by $\alpha°$ relative to the collecting cylinder to assume an initial position in which one holding member 56 of the collecting cylinder is abutted against one serrated knife 54 of the folding cylinder, and the two cylinders are rotated from this initial position, the tucker blade 53 of the folding cylinder and mounted within elongated axial grooves circumferentially formed in the middle of each adjacent grooves 63 (in this illustrated case, in radially opposing positions which are 90° shifted from the elongated axial grooves 63), the first jaws 64 being retractable inward of the circumferential surface of the gripping cylinder 62 by operation of a cam mechanism which will be described hereinlater and constituting a gripping means along with the tucker blades 53 on the folding cylinder 44. Moreover, n-number of second tucker blades 65 similar to the first tucker blades 53 on the folding cylinder 44 are provided in the circumferential positions intermediate between the elongated axial grooves 63 and the first jaws 64 and backward of the first jaws 64 as seen in the direction of rotation of the gripping cylinder 62, i.e. at positions 90°/n downstream of the first jaws 64. Further, 2n (in this illustrated case four) elongated axial grooves 66 are provided in equally spaced positions on the circumference of the gripping cylinder 62, i.e. in the positions $\alpha°$ shifted from the first jaws 64 and grooves 63 backward as seen in the direction of rotation of the gripping cylinder 62, to meet the serrated knives 54 on the folding cylinder 44.

Therefore, in the illustrated case, if the folding cylinder is rotated through $\alpha°$ from a position in which the cutting and holding means 45 of the folding cylinder 44 opposes the axial groove 63 on the gripping cylinder 62, the serrated knife 54 of the folding cylinder 44 meets the axial groove 63 on the gripping cylinder 62. Upon a further rotation of the folding cylinder 44 through $90° - \alpha 20$, the tucker blade 53 and the jaw 64 meet with each other. A further rotation through $\alpha°$ brings the serrated knife 54 into engagement with the axial groove 66. By a further $90° - \alpha°$ rotation of the folding cylinder, that is, at a half turn from the initial position, the cutting and holding means 45 is caused to meet the axial groove 63 on the gripping cylinder.

Thus, during one revolution of the folding cylinder 44, the gripping cylinder also makes one revolution to have a confrontation of the tucker blade 53 of the folding cylinder with the jaw 64 of the gripping cylinder two times during that period of rotation.

On the side away from the folding cylinder 44, the collecting cylinder 55 is in association with a pin cylinder 67 which has an effective diameter same as that of the plate cylinder and which is rotatable in the inverse direction as indicated by arrow F and at a circumferential speed same as the collecting cylinder 55. The pin cylinder 67 is provided with a row axially aligned pins 68 at an arbitrary position on the circumference thereof to serve as a second holding member.

The pin cylinder 67 is arranged such that the pins 68 confront with the first holding member 56 of the collecting cylinder 55 and provided with an axial groove **68*a* on its circumference at a position radially opposite to the pins 68. Therefore, upon a half turn of the pin cylinder from a position in which the pins 68 of the pin cylinder 67 are confronted with one holding member 56 of the collecting cylinder 55, the collecting cylinder 56 makes a $\frac{1}{3}$ turn to confront the groove 68*a* with the next holding member 56 of the collecting cylinder, and, upon a further half turn, the pins 68 are met by the holding member 56** which comes next.

On the side away from the folding cylinder 44, the gripping cylinder 62 is in association with a delivery cylinder 69 which has an effective diameter same as that of the plate cylinder and which is rotatable in a direction inverse of the gripping cylinder 62, as indicated by arrow G. The delivery cylinder 69 is provided with second jaws 70 similar to the jaws 64 on the gripping cylinder 62, the jaws 70 being mounted axially in an arbitrary position on the circumference of the delivery cylinder 69.

The delivery cylinder 69 is arranged such that the jaws 70 are abutted against the tucker blades 65 on the gripping cylinder 62 and provided with an axial groove **70*a* on its circumference in a position 90° forward of the jaws 70 as seen in the direction of rotation of the cylinder. Therefore, in the illustrated case, while the gripping cylinder 62 is rotated through 135° from the position in which the tucker blades 65 on the gripping cylinder 62 and the jaws 70 on the delivery cylinder 69 are confronted with each other, the delivery cylinder 69 makes a 270° turn to confront the jaws 64 with the axial groove 70*a*. While the gripping cylinder 62 makes a half turn from the initial position, the delivery takes a full turn to bring the next tucker blade 65 into confrontation with the jaws 70**.

The respective cylinders which are arranged in the above-described manner are rotatingly driven as follows. Referring to FIG. 6(*a*), a gear 71 which is driven from a suitable drive means (not shown) is mounted on the shaft of the pin cylinder 67 and meshed with a gear 72 which is mounted on the shaft of the collecting cylinder 55. A gear 73 is integrally clamped to the gear 72 by bolts **73*a* to drive a train of gears 74, 75 and 76 which rotatingly drive the folding cylinder 44, gripping cylinder 62 and delivery cylinder 69, respectively. As shown in FIG. 6**(*b*), the bolts **73*a* which joins the gears 72 and 73 are received in arcuate slots 77 to allow adjustment of relative position through a certain angle about the common axis. The adjustable angle corresponds to the angle $\alpha°$ which is the difference in phase between the cutting and holding means 45 of the folding cylinder 44 and the serrated knife 54** which is located backward as seen in the direction of rotation of the folding cylinder.

Figure 11:
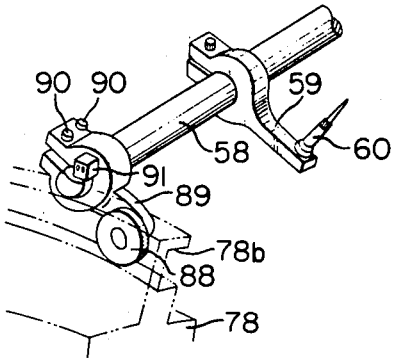
FIG. 11 is a fragmentary perspective view illustrating the holding member.
Figure 12:
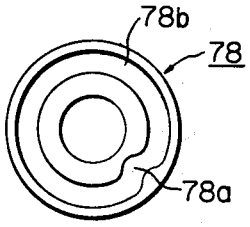
FIGS. 12, 13(*a*) and 13(*b*) are plan views showing cam members of FIG. 6(*a*)

A cam 78 is mounted loosely and rotatably on the shaft of the collecting cylinder 55 to project and retract the pins 60 of the holding member 56 through the lever shaft 58 and levers 59. As seen in FIG. 12 which show the cam 78 in plan view, the cam 78 has a cam groove **78*b* with an inward depression 78*a* for engagement with a follower 88 of the holding member 56, as shown in FIG. 11. In this instance, the pins 60 of the holding member 56 are retracted inward of the circumferential surface of the collecting cylinder 55 when the follower 88 drops in the depression 78*a* of the cam groove 78*b*. The cam 78 has a gear 79 integrally formed therewith, which is driven by a gear 80 on the pin cylinder 67 through gears 81 and 82 in such a gear ratio as to rotate at a frequency 1.5 times greater than and in a direction same as the collecting cylinder 55. Therefore, as long as one of the three holding members 56 of the collecting cylinder is concerned, its pins 60 are once rectracted inward of the circumferential surface of the collecting cylinder during two revolutions thereof by the engagement of the depression 78*a* of the cam 78 with the follower 88 of the holding member 56. The two revolutions of the collecting cylinder cause that holding member 56 to confront two times with the cutting and holding means 45 of the folding cylinder 44 to hold the two severed web sheets on the pins 60** in superimposed state.

Indicated at 83 is a cam which is securely mounted on the folding and cutting section 23 to project and retract the pins 52 on the folding cylinder 44 through the lever shaft 50 and levers 51, and formed with a cam groove similar to the one on the afore-mentioned cam member 78 to retract the pins 52 inward of the circumferential surface of the folding cylinder 44 at a predetermined position in relation with the rotation of the folding cylinder 44. Also securely mounted on the cutting and folding section 23 is a cam member 84 which is grooved similarly to the cam member 78 to open the jaws 70 at a predetermined position during rotation of the delivery cylinder 69.

Figures 13A, 13B:
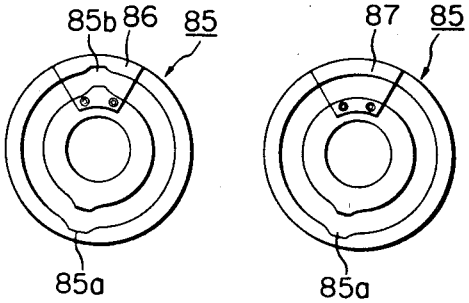

Further securely mounted at the end of the shaft of the gripping cylinder 62 on the opposite side of the cutting and folding section 23 is a cam member 85 which is, as shown in FIG. 13*a*, provided with an outward projection 85*a*, in its cam groove and a cam piece 86 with a similar projection 85*b* which is secured to the cam member 85 by screws at a position radially opposite to the projection 85*a*. Also available is a cam piece 87 which is not provided with any projection and attachable to the cam member 85 to provide a cam surface with a projection at 85*a* alone as shown in FIG. 13*b*. Either one of the cam pieces 86 and 87 is selectively used to vary the opening positions of the jaws 64 on the gripping cylinder 62. More particularly, as will be described in greater detail hereinlater, the cam piece 86 is used in the operational mode herein referred to as "P-delivery" to open the jaws 64 at a predetermined position by the action of the projection 85*b*. On the other hand, the cam piece 87 is used in the "R-delivery" to open the jaws at a predetermined position by the action of the projection 85*a*.

The pins 60 which are projected or retracted by the operation of the cam member 78 can shift their positions to prevent their projection out of the circumferential surface of the collecting cylinder irrespective of the operation of the cam 78, as shown in FIG. 11. For this purpose, after loosening the bolts 90 on the lever 89 of the cam follower 88, the lever shaft 58 is rotated to retract the pins 60 and then the bolts 90 are tightened again. The reference numeral 91 designates a stopper for blocking the rotation of the lever shaft 58. Similarly to the pins 60, the positions of the pins 52 are adjustable to prevent their projection out of the circumferential surface of the folding cylinder. In FIG. 6, the reference numerals 92 and 93 denote a mark and a pointer needle, respectively, for use in setting the collecting cylinder in position at the initial time of operation, and 94 and 95 are similarly a mark and a pointer needle for the folding cylinder 44.

Located below the pin cylinder 67 is an impeller wheel 96 which is provided with ten arcuate radially projecting blades in four rows in the axial direction. The impeller wheel 96 is rotated in the inverse direction as indicated by arrow H and at a frequency 1/10 the revolutions of the pin cylinder 67. A delivery tape 97 which is in travel in the direction of arrow J is provided beneath the impeller wheel 96 and, successively to the delivery tape 97, there is provided another delivery tape 98 is rockable about a belt wheel 99 in the terminal end portion thereof to assume a lifted position. When lifted, it is pressed against the delivery cylinder 69 by an intermediately located belt wheel 100. The rockably mounted web guides 102 have their fore ends plugged into annular grooves 101 on the outer periphery of the gripping cylinder 62, the web guides 102 being adapted to be locked in lifted or lowered positions. In contact with the upper side of the gripping cylinder 62, there is provided a delivery tape 103 running with the rotation of the gripping cylinder 62 and having a terminal end in association with an impeller wheel 104. The impeller wheel 104 is same in construction as the impeller wheel 96 and rotatable in the direction of arrow K to send the products toward a delivery tape 105 which is located beneath the impeller wheel 104. For this delivery operation, an intermediate belt wheel 106 of the delivery tape 105 is lifted to a position proximal to the impeller wheel 104.

A chopper-folder 107 is provided within the path of travel of the delivery tape 103 to fold in half the delivered signatures of known construction. Another impeller wheel 103 is provided beside the chopper-folder 107 to discharge the signatures which have been folded by the chopper-folder 107. The reference numerals 109 and 110 indicate delivery tapes which run in contact with the collecting and pin cylinders 55 and 67, respectively.

Figure 7:
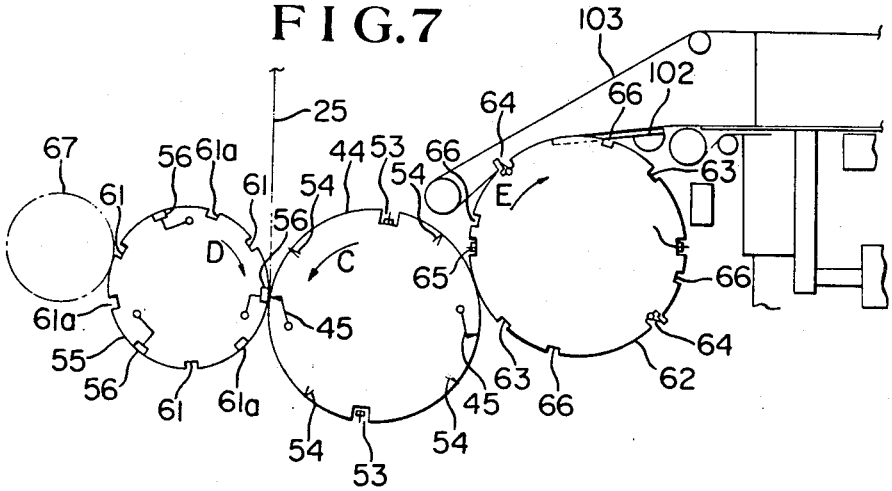
FIGS. 7, 8 and 9 show diagrammatically the organization of the cutting and folding section.
Figure 8:
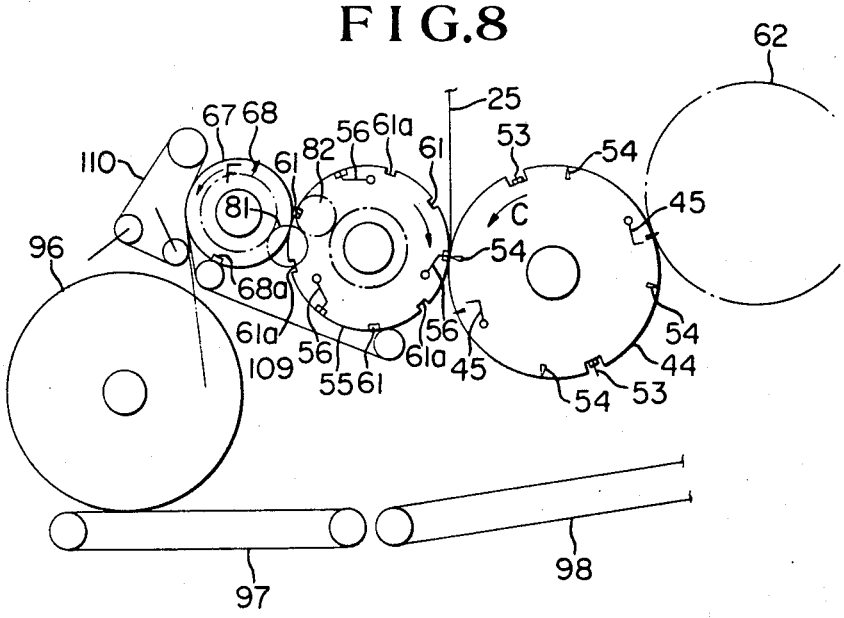
Figure 9:
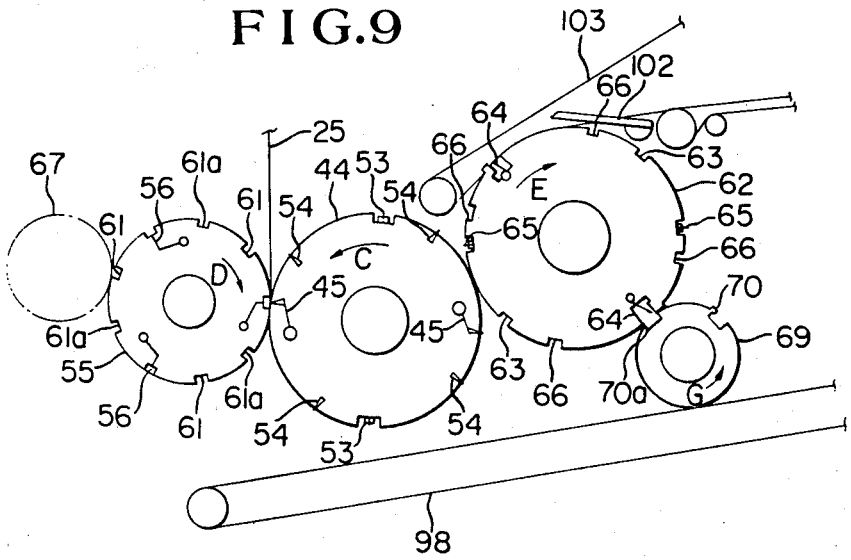

The above-described cutting and folding apparatus operates as follows. In the first place, it should be mentioned that the apparatus has three paths of delivery the arrangements of which are shown in FIGS. 7 through 9 while the operations are diagrammatically shown in FIGS. 14 through 16. FIGS. 7 and 14 show the mode of operation for producing a longitudinal fold in the signatures. This mode of operation is herein referred to as "P-delivery" for the convenience of explanation. In P-delivery, the pins 60 of the holding members 56 on the collecting cylinder 55 are not used. Therefore, the bolts 90 of FIG. 11 is loosened to preadjust the position of the lever shaft 58 by rotating same until it abuts against the stopper 91, and the bolts 90 are tightened again so that the pins 60 will not be projected out of the circumferential surface of the collecting cylinder 55 even if the levers 89 are rocked by the cam 78.

Figure 14A:
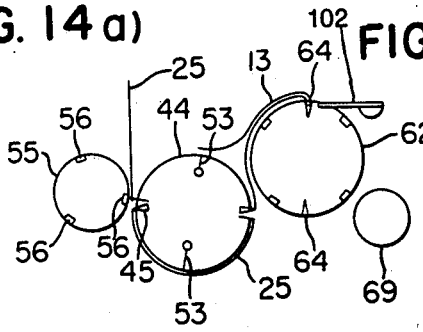
FIGS. 14(*a*) and (*b*) show diagrammatically the operation of the cutting and folding section illustrated in FIG. 7.
Figure 14B:
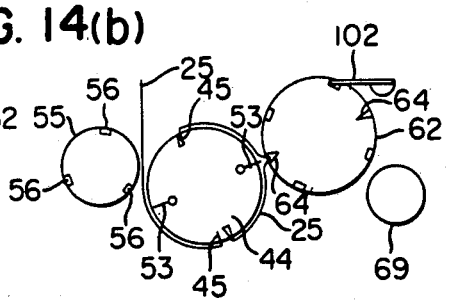
Figure 15A:
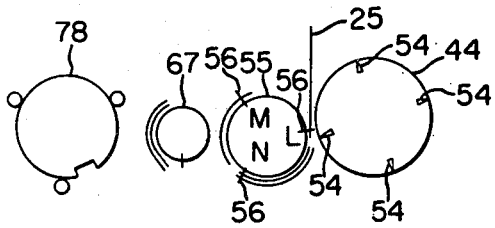
FIGS. 15(*a*) through (*g*) show diagrammatically the operation of the cutting and folding section illustrated in FIG. 8.
Figure 15B:
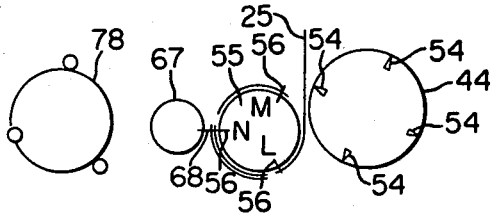
Figure 15C:
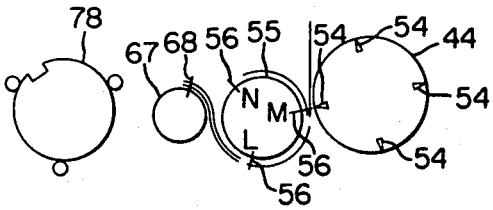
Figure 15D:
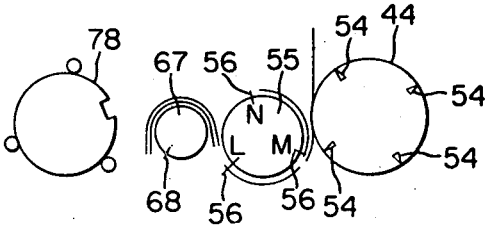
Figure 15E:
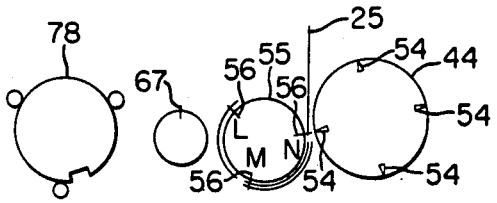
Figure 15F:
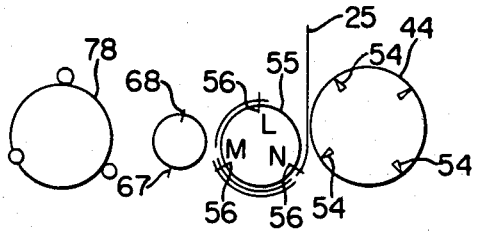
Figure 15G:
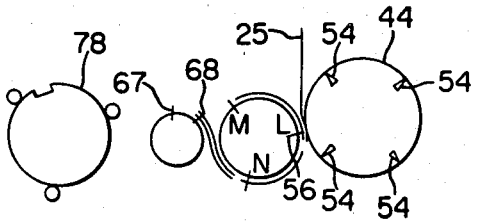

Thereafter, the web 25 is fed to the folding cylinder 44 and severed by the serrated knife 49 at the point where the cutting and holding means 45 on the folding cylinder 44 and the holding member 56 on the collecting cylinder 55 are confronted with each other the severed end of the web being held on the pins 52 which are projected by the operation of the cam member 83 and wound around the folding cylinder 44 as shown in FIGS. 14*a* and 14*b*. When the web is wound substantially around the circumference of the folding cylinder as shown in FIG. 14*b*, the tucker blade 53 on the folding cylinder 44 and the jaws 64 on the gripping cylinder 62 are confronted with each other to grip the web 25 at the middle portion thereof. At this time, the pins 52 are retracted by the action of the depressed portion of the cam 83 to release the sheet end. The signature 13 or the printed sheet which has been folded in half is taken over by the gripping cylinder 62. As soon as the jaws 64 reach the upper dead center on the gripping cylinder 62, the jaws 64 are opened by the action of the cam piece 86 on the cam 85 to release the signature 13 which is then gripped between the sheet guides 102 and the delivery tape 103 for transfer to a second delivery point.

FIGS. 8 and 15 show the mode of operation for producing two superimposed sheets, which is herein referred to as "Q-delivery" for the convenience of explanation. In Q-delivery, the bolts 73*a* are loosened to unfix the gear 73 from the gear 72 and then the gear 73 is manually rotated in the forward direction thereby to mesh the gears 73 to 76 for transmitting the rotational power to the respective cylinders from the folding cylinder 44 to the delivery cylinder 69. After rotating the gear 73 relative to the gear 72 to the limits of the arcuate slots 77, through an angle corresponding to the angular difference $\alpha°$ in phase between the cutting and holding means 45 and the serrated knife 54 on the folding cylinder 44, the bolts 73*a* are tightened again to fix the gears 72 and 73 to each other. In addition, the bolts 90 on the lever 89 of the collecting cylinder 55 are loosened to rotate the lever shaft 58 into the position at which the pins 60 are rendered protrudable out of the circumferential surface of the collecting cylinder 55. By similar procedures, the lever shaft 50 of the folding cylinder 44 is rotated into the position at which the pins 52 are rendered protrudable.

In the operation following these preadjustments, the web 25 is fed to the collecting cylinder 55 and severed at the position where a leading holding member 56 (indicated by L) on the collecting cylinder 55 is confronted by a serrated knife 54 on the folding cylinder 44, the severed printed sheet being wound around the collecting cylinder 55 with its severed end held on the pins 60 of the holding member 56. At the position where the next holding member 56 (indicated by M) is confronted by a serrated knife 54, the wound end portion of the succeeding web 25 is severed and superimposed on a printed sheet 25 which has already been wound on the collecting cylinder 55, with the severed end of the superimposed sheet similarly held on the pins 60. Meanwhile, the printed sheet 25 on the holding member 56(L) is rotated with the collecting cylinder 55 to the position shown at (g), the same position as at (a), to meet the end of a fourth printed sheet (counting from the one retained on L). The fourth printed sheet is retained on the holding member 56(L) and wound on the collecting cylinder 55 in superimposed relation with the first printed sheet. As soon as the holding member 56 which retains the ends of the two overlapped sheets is confronted by fixed pins 68 on the pin cylinder 67, the pins 60 are retracted by the action of the cam 78 to hand over the sheet ends to the fixed pins 68. The positions of the cam 78 relative to the operating cylinders in Q-delivery are also shown in FIG. 15. In this instance, the outer diameter of the collecting cylinder 55 is 1.5 times greater than that of the pin cylinder 67 and the revolutional frequency of the cam 78 is 1.5 times greater than that of the collecting cylinder 55 as mentioned hereinbefore, so that each time two superposed sheets are handed over to the pin cylinder 67. The printed sheets 25 or signatures 13 received on the pin cylinder 67 are gripped between the delivery tapes 109 and 110 and released at the lower ends thereof. The released signatures are captured between the blades of the impeller wheel 96 and dropped onto the delivery tape 97 to be transferred to a first delivery point. In the same manner as in P-delivery, the signatures are then transferred by the delivery tape 105.

FIGS. 9 and 16 show the mode of operation for producing twice folded signatures, which is herein referred to as "R-delivery" for the convenience of explanation. In order to switch the operation from Q-delivery to R-delivery, the pins 60 of the collecting cylinder 55 are retracted and the pins 52 of the folding cylinder are projected as in P-delivery. The gears 72 and 73 are returned to the positions as in P-delivery. In addition, the delivery tape 98 is used in the raised position, and the cam 85 employs the cam piece 87. Further, the sheet guides 102 are raised to disengage from the gripping cylinder 62.

In the operation after these adjustments, the web 25 is wound around the entire circumference of the folding cylinder 44 in the same manner as in P-delivery and then gripped by the jaws 64 at the intermediate portion thereof and wound around the gripping cylinder 62. In this instance, the signature is not released at this position since the cam 85 employs the cam piece 87 and the sheet guides 25 are in open positions, so that the printed sheet 25 is carried in the gripped state to the position shown at (d). At this position, the tucker blade 65 on the gripping cylinder 62 is confronted by the jaws 70 on the delivery cylinder 69, gripping the intermediate portion of the once folded printed sheet 25. Simultaneously, the jaws 64 are opened by the action of the projection 85*a* of the cam 85 to release the sheet end. The longitudinally twice folded sheet 25 or signature 13 is forwarded onto the delivery tape 98 by the delivery cylinder and then onto the delivery tape 105 for transfer to a third delivery point.

In P- and R-delivery of the above-described operations by the cutting and folding section, the web 25 is severed at each 1/n (in this illustrated case half) turn of the folding cylinder 44 since n (in the illustrated case two) sets of cutting and holding means 45 and 56 are provided between the folding cylinder and the gripping cylinder each having a n times (in the illustrated case doubled) effective diameter as compared with the plate cylinder. The severed printed sheet with a free end and the web leading from the web feed section are separately wound around the folding cylinder 44 at each 1/n (in the illustrated case half) turn thereof, and the gripping action by the gripping member 53 and 64 is performed on the severed printed sheet 25 which is wound on the folding cylinder 44. Therefore, variations in tension resulting from the gripping action are caused only to the printed sheet 25 with a freed end and not transmitted to the succeeding web 25, thereby ensuring the web feeding and folding operations to proceed under very stable condition.

Figure 17:
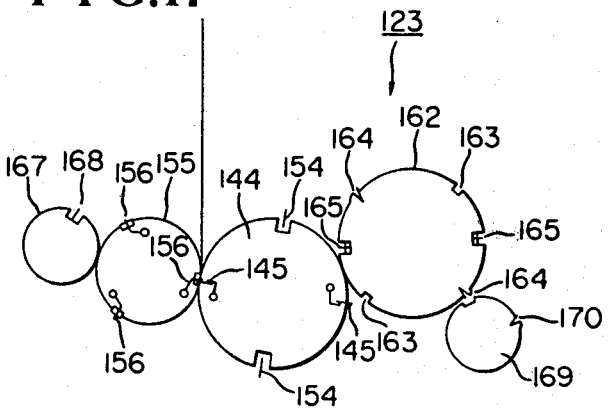
FIG. 17 shows diagrammatically the organization of another cutting and folding section of the invention.
Figure 16A:
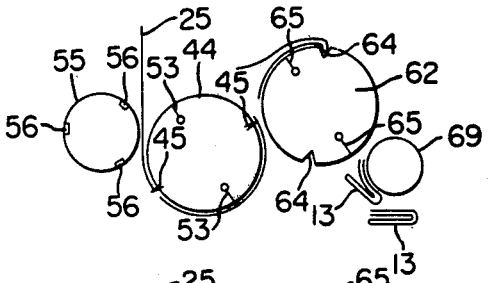
FIGS. 16(*a*) through (*e*) show diagrammatically the operation of the cutting and folding section illustrated in FIG. 9.
Figure 16B:
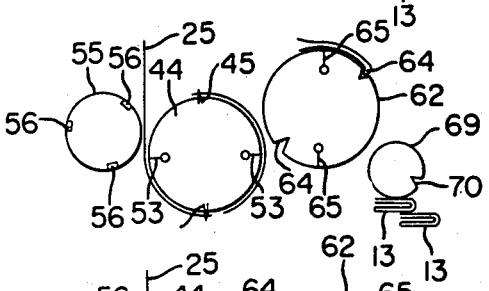
Figure 16C:
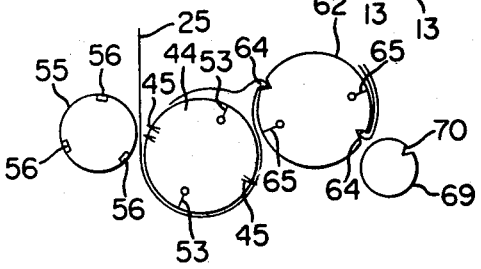
Figure 16D:
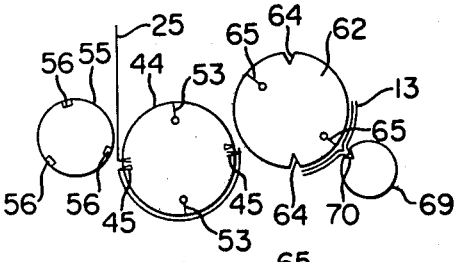
Figure 16E:
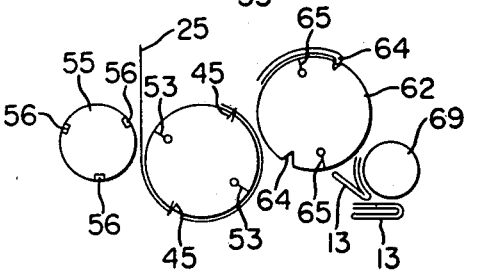

FIGS. 17 and 18 show another embodiment of the folding and cutting section, in which the components designated at 123, 144, 145, 155, 156, 162 to 165 and 167 to 170 correspond to and are the as the components 23, 44, 45, 55, 56, 62 to 65 and 67 to 70 of FIG. 3, respectively, in both functions and features. In this embodiment, the tucker blades 153 are detachably mounted on the folding cylinder 144 and used in P- and R-delivery (FIG. 18). In Q-delivery, knives 154 such as serrated knives are used (FIG. 17). As seen from FIG. 18 or 19, this embodiment dispenses with the knives 54 of the folding cylinder 44, axial grooves 61 and 61*a* of the collecting cylinder 55 and the axial grooves 66 of the gripping cylinder 62 in the embodiment of FIG. 3. Moreover, it becomes unnecessary to preadjust the phase of the gears 72 and 73 when switching the mode of operation between P- or R- and Q-delivery. In the case of Q-delivery, however, it is necessary to detach the jaws 164 off the gripping cylinder 162 since otherwise the knives 154 will hit thereagainst.

According to the present invention, a variety of signatures are obtained by switching path of travel in the web feed section in addition to the switching between the three different modes of the cutting and folding section. The path B feeds the web in the same state as received from the printing section, while the path A longitudinally folds the web en route by the former 36. In addition, if the slitter 30 is switched on during travel through the path B, the web is longitudinally severed into strips of half width. Signatures of still different kind can be produced by switching on the chopper 107 in P-delivery. The following table shows the particulars of a variety of signatures which are produced by switching the operations of the respective sections of the apparatus in a number of different combinations. The characters in the leftmost column of the table correspond to the characters labeled on the perspective views of signatures in FIG. 19.

| | Size of Signature | Number of Pages | Number of Copies | Mode of Delivery | Feeding Path | Remarks |
|---|---|---|---|---|---|---|
| (a) | A3 | 2 | 2 | Q | B | |
| (b) | " | 4 | 1 | P | B | |
| (c) | A4 | 8 | 1 | P | B | Chopper ON |
| (d) | " | 8 | 1 | P | A | |
| (e) | " | 4 | 2 | Q | A | |
| (f) | " | 4 | 2 | P | B | Slitter ON |
| (g) | " | 2 | 4 | Q | B | Slitter ON |
| (h) | A5 | 16 | 1 | R | A | |
| (i) | " | 8 | 2 | R | B | Slitter ON |
| (j) | " | 8 | 1 | R | B | |

The foregoing embodiments have been shown as having three modes of delivery of P, Q and R. However, R-delivery is not essentially required and therefore the related component parts and the mechanisms for switching to this mode of delivery may be omitted if desired.

It will be apparent from the foregoing description that, according to the present invention, there is provided a cutting and folding apparatus for rotary press, which comprises a folding cylinder of a diameter two or more (integral number) times, preferably two times as large as the plate cylinder, and a gripping cylinder of a diameter same as the folding cylinder and a collecting cylinder of a diameter 1.5 times as large as the plate cylinder which are provided opposingly in positions downstream of the folding cylinder, and a pin cylinder having the same diameter as the plate cylinder and located opposingly downstream of the collecting cylinder, and cutting and holding members provided cooperatively on the respective cylinders, and adapted to perform single transverse folding or if desired double transverse folding on the gripping cylinder or superposition of two sheets on the collecting cylinder by simple switching operation, thereby to produce different kinds of signatures with extremely high efficiency and precision and without requiring separate or additional cutting or folding processes or apparatus which are designed for a particular kind of signature. This contributes to the simplification of the process and the reduction of the cost of facilities or to add to other practical advantages. The provision of a folding cylinder of a diameter n-times (n=an integer of 2 or more) as great as the plate cylinder in combination with cutting and holding means which are actuated at each half turn of the folding cylinder precludes the variations in tension which would otherwise be caused to the succeeding web by the operation of the cutting and folding section and realizes stable precision folding and operations at higher speeds. Further the former and slitter which are provided in parallel, by combination with the transverse folding and superimposing operations of the cutting and folding section, all the more increase the kinds of signatures which can be produced by one and single apparatus to meet various requirements. Furthermore, in a case of parallel feed, the two slitted webs are suitably spaced from each other by the pair of slanted turn bars in the web feed section to ensure smooth transfer and folding of the respective webs. Irrespective of the path of travel in the feed section and the mode of operation in the cutting and folding section, the signatures are delivered to the same point to attain higher efficiency.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A rotary press including a plate cylinder for printing a web travelling at a predetermined linear speed, and a web feed section for receiving the printed web from the plate cylinder and feeding the web to a cutting and folding section at the predetermined linear speed, said cutting and folding section comprising: a folding cylinder positioned on one side of the web and having a diameter about two times as large as the diameter of the plate cylinder; a collecting cylinder disposed on the opposite side of said web forming a nip with said folding cylinder and having a diameter about 1.5 times as large as the diameter of the plate cylinder; a gripping cylinder disposed at a side of said folding cylinder remote from said collecting cylinder for removing sheets from the folding cylinder and having a diameter about 2 times as large as the diameter of the plate cylinder; a pin cylinder disposed adjacent said collecting cylinder for removing sheets from the collecting cylinder and having the same diameter as the plate cylinder; a cutting means disposed at the circumference of said folding cylinder and collecting cylinder operable to cut the printed sheet and to hold the cut edge at each half revolution of said folding cylinder; a first gripping means disposed at the circumference of said folding cylinder and gripping cylinder to grip said printed sheet cut by said cutting means at the central portion of said sheet and to transfer said sheet between said folding cylinder and gripping cylinder; and a second gripping means disposed at the circumference of said collecting cylinder and pin cylinder to transfer said printed sheet between both said cylinders.

2. A rotary press including a plate cylinder for printing a web travelling at a predetermined linear speed, and a web feed section for receiving the printed web from the plate cylinder and feeding the web to a cutting and folding section at the predetermined linear speed, said cutting and folding section comprising: a folding cylinder positioned on one side of the web and having a diameter n-times as large as the diameter of the plate cylinder, where n is an integer of at least 2, and rotatable at a circumferential speed the same as the linear speed of the travelling web; a collecting cylinder disposed on the opposite side of said web forming a nip with said folding cylinder and having a diameter 1.5 times as large as the diameter of the plate cylinder, said collecting cylinder being rotatable at the same circumferential speed as and in a direction inverse of the folding cylinder; a gripping cylinder disposed adjacent said folding cylinder for removing sheets therefrom and having a diameter the same as the folding cylinder, said gripping cylinder being rotatable at the same circumferential speed as and in a direction inverse of said folding cylinder; a pin cylinder disposed adjacent said collecting cylinder for removing sheets therefrom and having the same diameter as the plate cylinder, said pin cylinder being rotatable at the same circumferential speed as and in a direction inverse of said collecting cylinder; n-number of web cutting and holding means and n-number of first web tucker blades alternately and equidistantly mounted on the circumference of said folding cylinder, each one of said web cutting and holding means being adapted to release its hold at a predetermined position; 2n of first cutting knives mounted on said folding cylinder in positions intermediate adjacent web cutting and holding means and first tucker blade; three first web holding members circumferentially equally spaced on said collecting cylinder, each first web holding member being cooperative with either one of said web cutting and holding means or one of said first cutting knives and operable to release its hold at each two revolutions of said collecting cylinder, so that the web fed between said folding and collecting cylinders from the web feed section, (a) is transversely severed successively at each revolution of said collecting cylinder into n-number of first severed sheets each having a length the same as the circumferential length of the plate cylinder when said first holding members on said collecting cylinder are in cooperation with said cutting and holding means on said folding cylinder, said first severed sheets being held on said cutting and holding means to be carried by said folding cylinder, or (b) is transversely severed successively at each revolution of said folding cylinder into 2n-number of second severed sheets each having a length half the circumferential length of the plate cylinder when said first holding members on said collecting cylinder are in cooperation with said first cutting knives on said folding cylinder, said second severed sheets being successively held by said first holding members and carried by said collecting cylinder such that every third one of the second severed sheets is superimposed on the first one; a second holding member provided on said pin cylinder to receive said two superimposed second sheets carried by the collecting cylinder and to deliver said superimposed sheets to a first delivery location; and n-number of first jaws circumferentially equally spaced on said gripping cylinder and each being cooperative with one of said first tucker blades of said folding cylinder for transversely folding said first severed sheets successively to form folded signatures, holding the said folded signatures and delivering same to a second delivery location.

3. A rotary press according to claim 2, further comprising a delivery cylinder disposed adjacent said gripping cylinder and having the same diameter as the plate cylinder, said delivery cylinder being rotatable at the same circumferential speed as and in a direction inverse of said gripping cylinder; n-number of second tucker blades circumferentially equally spaced on said gripping cylinder and at positions shifted in the direction of rotation by 90°/n from said first jaws; and a second jaw provided circumferentially on said delivery cylinder and adapted to cooperate with each one of said second tucker blades for further transversely folding said folded signature held by each one of said first jaws and to deliver said twice folded signature to a third delivery location.

4. A rotary press according to claim 2 or 3, wherein said web feed section comprises means for folding the running printed web along a line parallel to the direction of movement of the printed web, the resulting folded web being fed to said cutting and folding section.

5. A rotary press according to claim 2 or 3, wherein said web feed section comprises means for slitting the running printed web into two strips, the resulting two strips being fed to said cutting and folding section.

6. A rotary press according to claim 2, further comprising a chopper folder for producing a fold in said folded signature along a line parallel to its direction of movement.

7. A rotary press according to claim 6, wherein said web feed section comprises means for folding the running printed web along a line parallel to the direction of movement of the printed web, the resulting folded web being fed to said cutting and folding section.

8. A rotary press according to any one of claims 6 through 7, wherein said web feed section comprises means for slitting the running printed web into two strips, the resulting two strips being fed to said cutting and folding section.

9. A rotary press according to claim 6, further comprising a chopper folder for producing a fold in said folded signature along a line parallel to its direction of movement.

10. A rotary press including a plate cylinder for printing a web travelling at a predetermined linear speed, and a web feed section for receiving the printed web from the plate cylinder and feeding the web to a cutting and folding section at the predetermined linear speed, said cutting and folding section comprising: a folding cylinder positioned on one side of the web and having a diameter twice as large as the diameter of the plate cylinder and rotatable at a circumferential speed same as the linear speed of the travelling web; a collecting cylinder disposed on the opposite side of said web forming a nip with said folding cylinder and having a diameter 1.5 times as large as the diameter of the plate cylinder, said collecting cylinder being rotatable at the same circumferential speed as and in a direction inverse of the folding cylinder; a pin cylinder disposed adjacent said collecting cylinder for removing sheets therefrom and having the same diameter as the plate cylinder, said pin cylinder being rotatable at the same circumferential speed as and in a direction inverse of said collecting cylinder; two cutting and holding means and two first cutting knives alternately and equidistantly mounted on the circumference of said folding cylinder, each one of said cutting and holding means being adapted to release its hold at a predetermined position; three first holding members circumferentially equally spaced on said collecting cylinder each first holding member being cooperative with one of said cutting and holding means and said first cutting knives and operable to release its hold at each two revolutions of said collecting cylinder, so that the web fed between said folding and collecting cylinders from the web feed section is transversely severed successively at each revolution of said folding cylinder into 2n-number of second severed sheets each having a length half the circumferential length of the plate cylinder, said second severed sheets being successively held by said first holding members and carried by said collecting cylinder such that every third one of the second severed sheets is superimposed on the first one;

a second holding member provided on said pin cylinder to receive said two superimposed second sheets carried by the collecting cylinder and to deliver said superimposed sheets to a first delivery location.

11. A rotary press including a plate cylinder for printing a web travelling at a predetermined linear speed, and a web feed section for receiving the printed web from the plate cylinder and feeding the web to a cutting and folding section at the predetermined linear speed, said cutting and folding section comprising: a folding cylinder positioned on one side of the web and having a diameter twice as large as the diameter of the plate cylinder and rotatable at a circumferential speed same as the linear speed of the travelling web; a collecting cylinder disposed on the opposite side of said web forming a nip with said folding cylinder and having a diameter 1.5 times as large as the diameter of the plate cylinder, said collecting cylinder being rotatable at the same circumferential speed as and in a direction inverse of the folding cylinder; means for on the one hand deliverying unfolded sheets to a first location comprising a pin cylinder positioned on the opposite side of the collecting cylinder from the folding cylinder for removing sheets from the collecting cylinder and deliverying to said first location, means for on the other hand deliverying folded sheets to a second location comprising a gripping cylinder disposed adjacent said folding cylinder for removing sheets therefrom and having a diameter same as the folding cylinder, said gripping cylinder being rotatable at the same circumferential speed as and in a direction inverse of said folding cylinder; two cutting and holding means and two first tucker blades alternately and equidistantly mounted on the circumference of said folding cylinder, each one of said cutting and holding means being operable to release its hold at a predetermined position; three first holding members circumferentially equally spaced on said collecting cylinder, each first holding member being cooperative with one of said cutting and holding means, so that the web fed between said folding and collecting cylinders from the web feed section is transversely severed successively at each revolution of said collecting cylinder into two of first severed sheets each having a length same as the circumferential length of the plate cylinder, said first severed sheets being held on said cutting and holding means to be carried by said folding cylinder; and two first jaws circumferentially equally spaced on said gripping cylinder and each being in cooperation with one of said first tucker blades on said folding cylinder for transversely folding said first severed sheets successively to form folded signatures, holding the said folded signatures and delivering same to a second delivery location.

12. A rotary press according to claim 11, further comprising a delivery cylinder disposed adjacent said gripping cylinder and having the same diameter as the plate cylinder, said delivery cylinder being rotatable at the same circumferential speed as and in a direction inverse of said gripping cylinder; two second tucker blades circumferentially equally spaced on said gripping cylinder and at positions shifted downstream by 45° from said first jaws; and a second jaw provided circumferentially on said delivery cylinder and operable to cooperate with each one of said second tucker blades for further transversely folding said folded signature held by each one of said first jaws and to deliver said twice folded signature to a third delivry location.

* * * * *

UNITED STATES PATENT AND TRADEMARK OFFICE

CERTIFICATE OF CORRECTION

PATENT NO. : 4,368,879

DATED : January 18, 1983

INVENTOR(S) : Toshio Hoshi

It is certified that error appears in the above-identified patent and that said Letters Patent is hereby corrected as shown below:

Column 4, line 67, change "t" to -- t --;

Column 7, line 40, change "90°-a20," to -- 90°-a° --;

Column 10, line 3, change "plugged" to -- plunged --;

Column 18, line 15 of Claim 11, change

"blades on said" to -- blades of said --.

Signed and Sealed this

Fourth Day of October 1983

[SEAL]

*Attest:*

GERALD J. MOSSINGHOFF

*Attesting Officer* *Commissioner of Patents and Trademarks*